US007793710B2

(12) United States Patent
Lamich et al.

(10) Patent No.: US 7,793,710 B2
(45) Date of Patent: Sep. 14, 2010

(54) INTERCOOLER APPARATUS AND METHOD

(75) Inventors: Bernhard Lamich, Esslingen (DE); Denis Bazika, Esslingen (DE)

(73) Assignee: Modine Manufacturing Company, Racine, WI (US)

( * ) Notice: Subject to any disclaimer, the term of this patent is extended or adjusted under 35 U.S.C. 154(b) by 951 days.

(21) Appl. No.: 11/634,513

(22) Filed: Dec. 6, 2006

(65) Prior Publication Data

US 2007/0193731 A1 Aug. 23, 2007

(30) Foreign Application Priority Data

Dec. 9, 2005 (DE) ..... 10 2005 058 769

(51) Int. Cl.
*F28F 1/00* (2006.01)

(52) U.S. Cl. ..... 165/149; 165/67; 165/176; 165/173; 165/153; 228/183

(58) Field of Classification Search ..... 165/148, 165/153, 176, 67, 149; 29/890.052; 228/183
See application file for complete search history.

(56) References Cited

U.S. PATENT DOCUMENTS

| | | | | |
|---|---|---|---|---|
| 3,444,926 | A * | 5/1969 | Stalberg | 165/166 |
| 3,939,908 | A * | 2/1976 | Chartet | 165/149 |
| 4,081,025 | A * | 3/1978 | Donaldson | 165/140 |
| 5,042,577 | A * | 8/1991 | Suzumura | 165/153 |
| 5,211,222 | A * | 5/1993 | Shinmura | 165/176 |
| 5,435,383 | A * | 7/1995 | Rajagopal | 165/167 |
| 5,607,012 | A * | 3/1997 | Buchanan et al. | 165/173 |
| 5,875,834 | A * | 3/1999 | Brooks | 165/11.1 |
| 5,964,282 | A * | 10/1999 | Seiler et al. | 165/153 |
| 6,220,340 | B1 * | 4/2001 | Cheong et al. | 165/103 |
| 6,467,536 | B1 * | 10/2002 | Abate et al. | 165/153 |
| 6,478,080 | B2 * | 11/2002 | Pinto | 165/153 |
| 6,571,866 | B2 * | 6/2003 | AbdulNour et al. | 165/153 |
| 6,918,434 | B2 * | 7/2005 | Strahle | 165/167 |
| 7,222,501 | B2 * | 5/2007 | Cho et al. | 62/515 |
| 7,303,003 | B2 * | 12/2007 | Ohhashi et al. | 165/149 |
| 7,367,386 | B2 * | 5/2008 | Sato et al. | 165/153 |
| 7,416,018 | B2 * | 8/2008 | Thunwall et al. | 165/67 |

(Continued)

FOREIGN PATENT DOCUMENTS

| | | |
|---|---|---|
| DE | 4307503 | 9/1994 |

(Continued)

*Primary Examiner*—Terrell L McKinnon
(74) *Attorney, Agent, or Firm*—Michael Best & Freidrich LLP

(57) ABSTRACT

Some embodiments of the disclosed heat exchanger have flat tubes, corrugated ribs, collection tubes, connection pieces, and a connection plate used (for example) for the attachment of the heat exchanger in a casing through which charge air flows, whereby the individual components of the heat exchanger can be manufactured from aluminum and can be soldered together. In some embodiments, at least four collecting tubes define coolant collection chambers, whereby coolant follows at least one outgoing route lying between first and the second collection tubes, and at least one return route proceeding in an opposite direction lying between third and fourth collecting tubes. The outgoing route can be provided in at least one flat tube-corrugated rib series, while the return route can be provided in at least another flat tube-corrugated rib series, arranged downstream of the first flat tube-corrugated rib series.

7 Claims, 5 Drawing Sheets

U.S. PATENT DOCUMENTS

| | | | | |
|---|---|---|---|---|
| 7,520,319 | B2 * | 4/2009 | Ohno | 165/153 |
| 2002/0139520 | A1 * | 10/2002 | Pinto | 165/153 |
| 2002/0179291 | A1 * | 12/2002 | Abate et al. | 165/153 |
| 2004/0206490 | A1 * | 10/2004 | Katoh et al. | 165/174 |
| 2006/0162918 | A1 * | 7/2006 | Horiuchi et al. | 165/176 |
| 2007/0144721 | A1 * | 6/2007 | Watanabe et al. | 165/174 |
| 2007/0251681 | A1 * | 11/2007 | Higashiyama et al. | 165/153 |
| 2007/0277964 | A1 * | 12/2007 | Higashiyama et al. | 165/153 |

FOREIGN PATENT DOCUMENTS

| | | |
|---|---|---|
| DE | 4407080 | 9/1994 |
| DE | 69019633 | 11/1995 |
| DE | 19833845 | 2/2000 |
| DE | 19859756 | 7/2000 |
| DE | 19933913 | 2/2001 |
| DE | 19961199 | 6/2001 |
| DE | 102004009415 | 9/2005 |

* cited by examiner

INTERCOOLER APPARATUS AND METHOD

CROSS-REFERENCE TO RELATED APPLICATIONS

Priority is hereby claimed to German Patent Application No. DE 10 2005 058 769.0 filed on Dec. 9, 2006, the entire contents of which are incorporated herein by reference.

BACKGROUND OF THE INVENTION

Flat tube intercoolers having multiple collection chambers exist in the art. Such intercoolers are known, for example, from DE 43 07 503 A1. There, the disclosed intercooler has a one-piece connection plate. Also, rather than having one-piece flat tubes in the intercooler, heat exchanger plates form the flat tubes.

Another heat exchanger which is presumably also an intercooler is known from DE 44 07 080 A1. The intercooler disclosed therein has no connection plate shown or described. The flat tubes are likewise constructed from plates.

The present invention takes this state of the art as a starting point, from which the inventors have been presented with the task of reducing the number of parts of the heat exchanger in order to lead to a better manufacturability (among other things).

SUMMARY

Some embodiments of present proposal provide an intercooler that is arranged in a casing through which charge air can flow. In addition, a characteristic of the design in some embodiments is the use of a special connection plate of the intercooler.

Manufacturability can be improved in some embodiments by the use of at least four collecting chambers (hereinafter "collecting tubes"), whereby coolant follows at least one outgoing route that lies between first and second collecting tubes, and a return route in an opposite direction that lies between the third and the fourth collecting tubes. The outgoing route and the return route, seen in the flow direction of the charging air, can be provided in flat tube-corrugated rib layers arranged one after another. Substantially shorter solder connections are available, which can reduce the danger of leaks. Also, in some embodiments, the first and fourth collecting tubes can be constructed as a double tube, and/or the second and third collecting tubes can be constructed as a double tube.

The collecting tubes can consist of round, rectangular, or oval tubes that contain a series of slits for the intake of the ends of flat tubes. The provision of intake slits can lead to an economical manufacturing of heat exchangers also yielding tight soldering connections.

In some embodiments, the collecting tubes extend parallel to each other. The connection plate referenced above can be constructed of multiple components, such as a two-components connection plate. One component of the connection plate can be a frame component, while the other can be a generally flat component. Also, in some embodiments, the flow connection between the second collecting tube and the third collecting tube takes place by means of the connection plate. For example, in the frame part of the connection plate, an excess flow dome can be constructed. The flat component of the connection plate can have at least four openings which receive the ends of the collection tubes.

The flat component in some embodiments of the connection plate can include a trough, whereby the trough rests on an outermost corrugated rib of the tube and fin assembly. Also, the frame component of the connection plate can rest flat upon the full perimeter of the edge of the trough.

As another alternative, the flow connection between the second and third collecting tubes can be provided at or near the ends of the second and third collection tubes opposite the connection plate.

The flat tubes can be constructed as single components. For example, a flat tube can be welded with a longitudinal weld, or can be a semi-finished part, such as a drawn or extruded flat tube.

On the ends of the collection tubes opposite the connection plate, an additional plate can be present that closes the ends of the collection tubes. This additional plate can be an end plate of the assembly.

BRIEF DESCRIPTION OF THE DRAWINGS

The present invention is described below with the aid of the enclosed embodiment drawings by way of example only.

The following description comprises additional characteristics and actions that are possibly of a greater significance than is expected at the present time.

DETAILED DESCRIPTION

Figure 13:
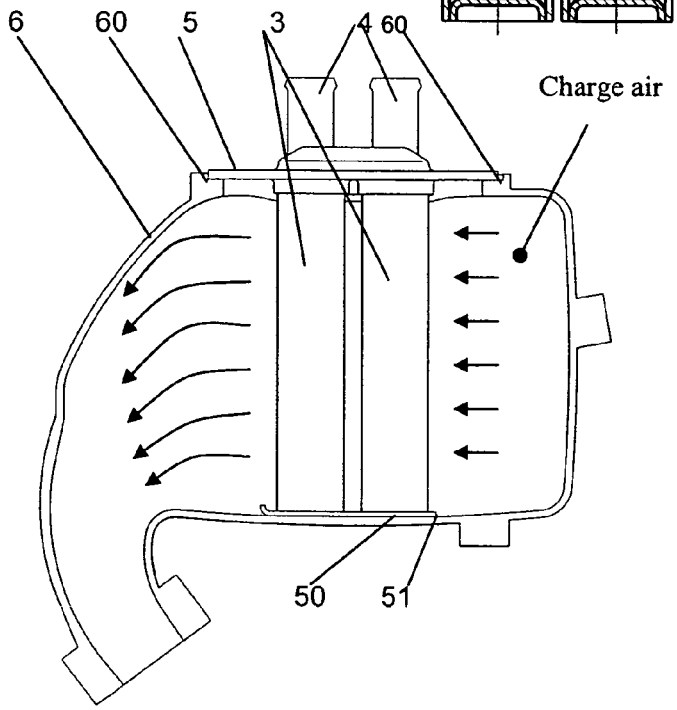
FIG. 13 shows a heat exchanger according to an embodiment of the present invention, arranged in a casing.

With reference first to FIG. 13, a casing 6 in which a heat exchanger of the present invention can be installed can be used in association with an internal combustion engine (not shown). The casing 6 can be connected to or around an air intake manifold and/or an air intake channel through which compressed and heated air flows due to the compression process from a compressor and/or turbo charger (also not shown). Such compressed and heated air can be supplied as combustion air in a cylinder of the internal combustion engine.

Figure 1:
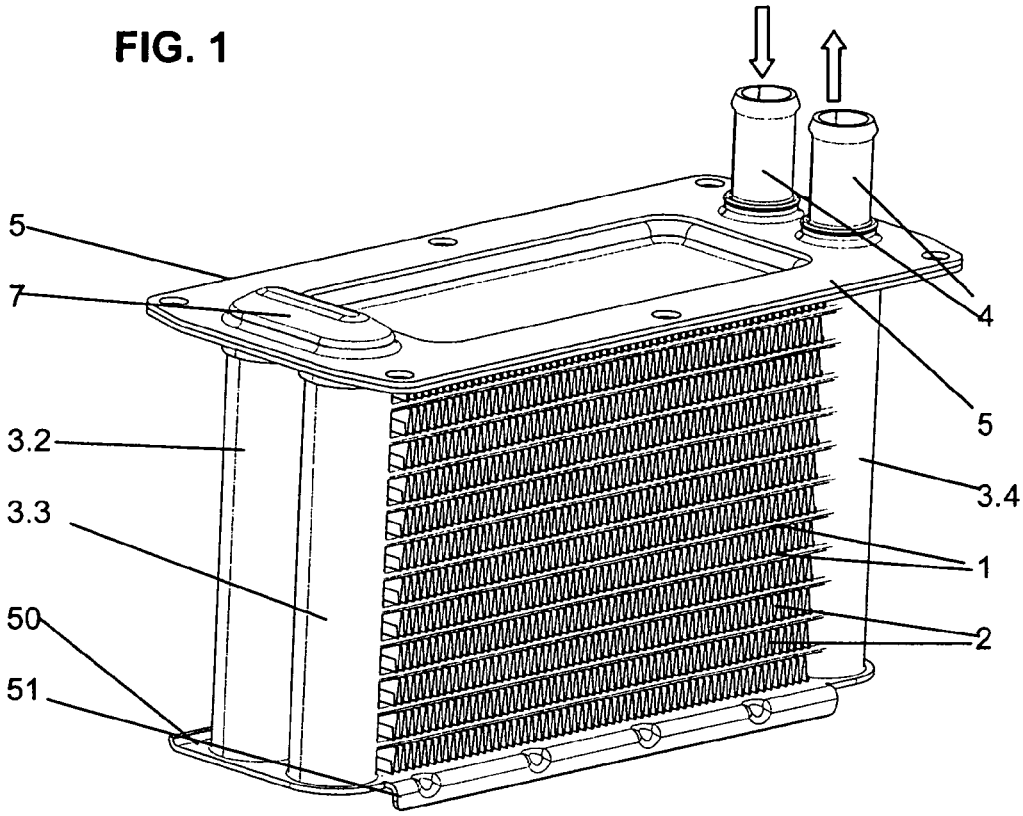
FIG. 1 shows a perspective view of a heat exchanger according to an embodiment of the present invention.
Figure 2:
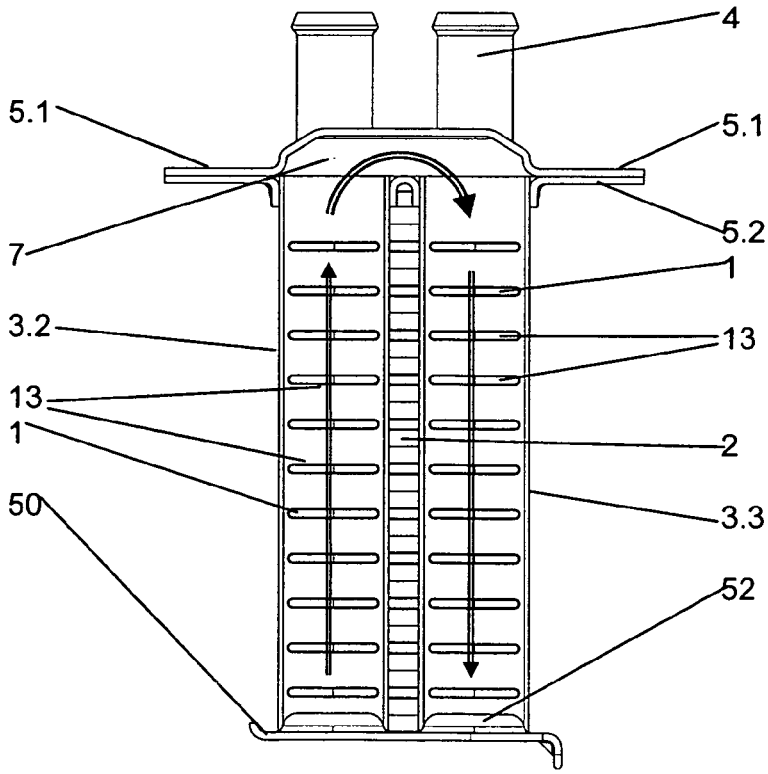
FIG. 2 shows a section through the heat exchanger of FIG. 1.
Figure 3:
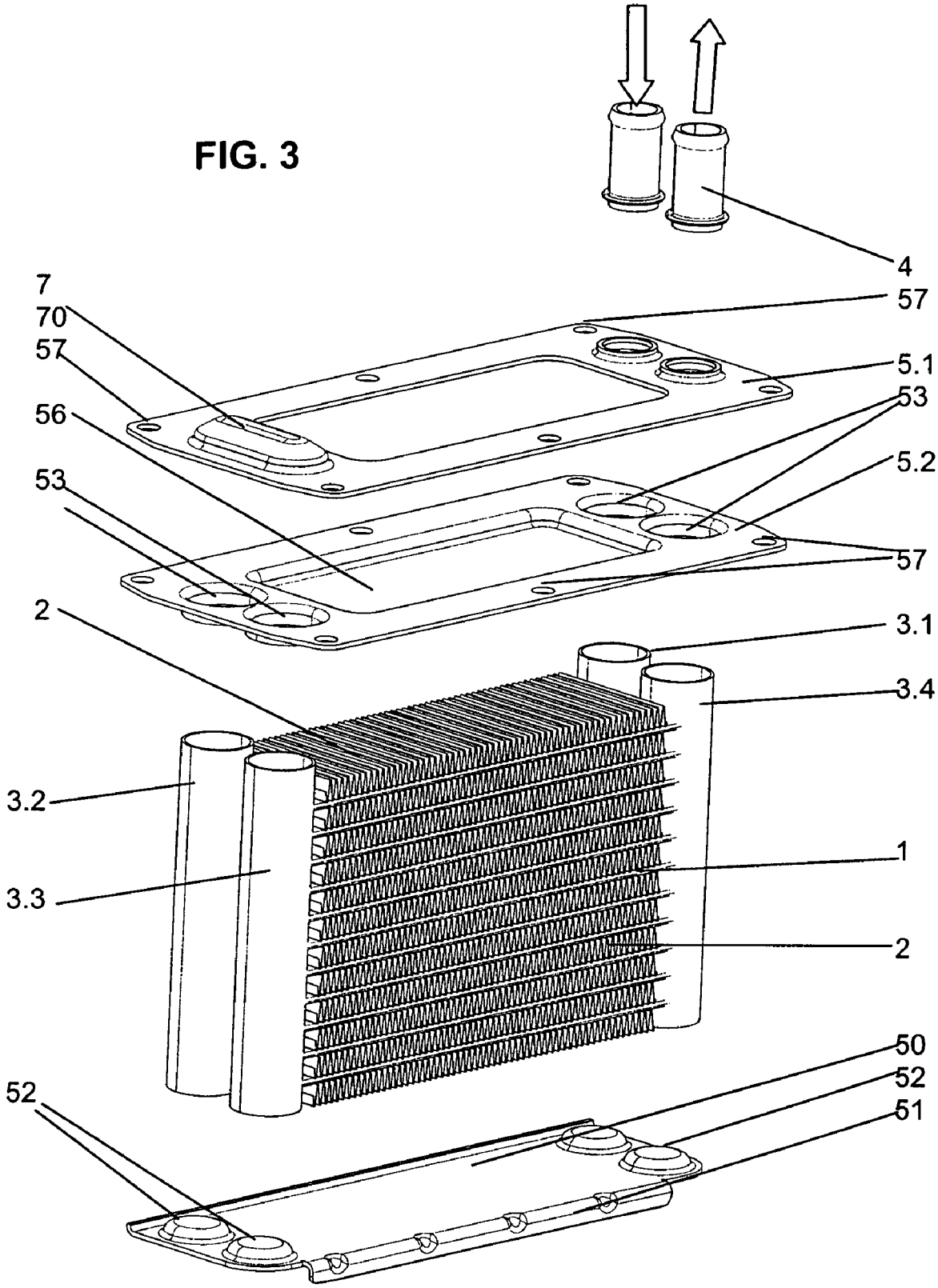
FIG. 3 shows the heat exchanger of FIG. 1 in an exploded representation.
Figure 4:
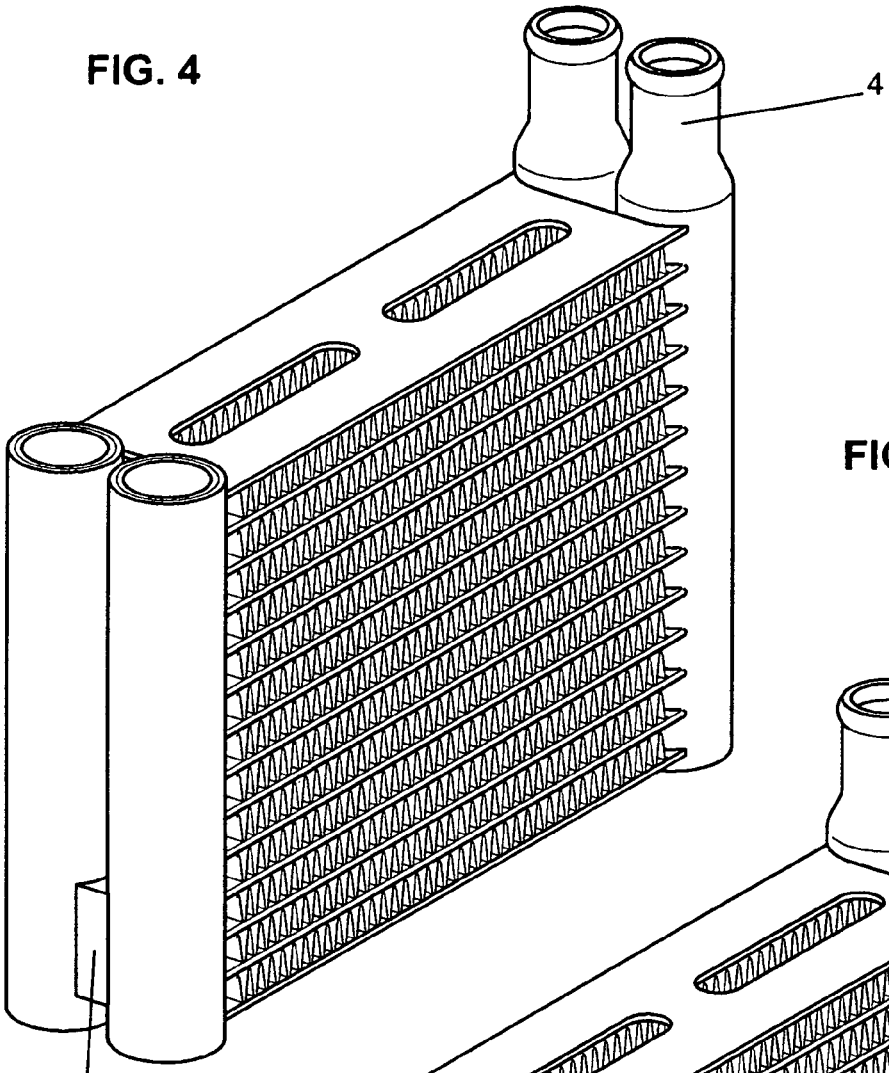
FIG. 4 shows a perspective view of a modified heat exchanger according to an embodiment of the present invention.
Figure 5:
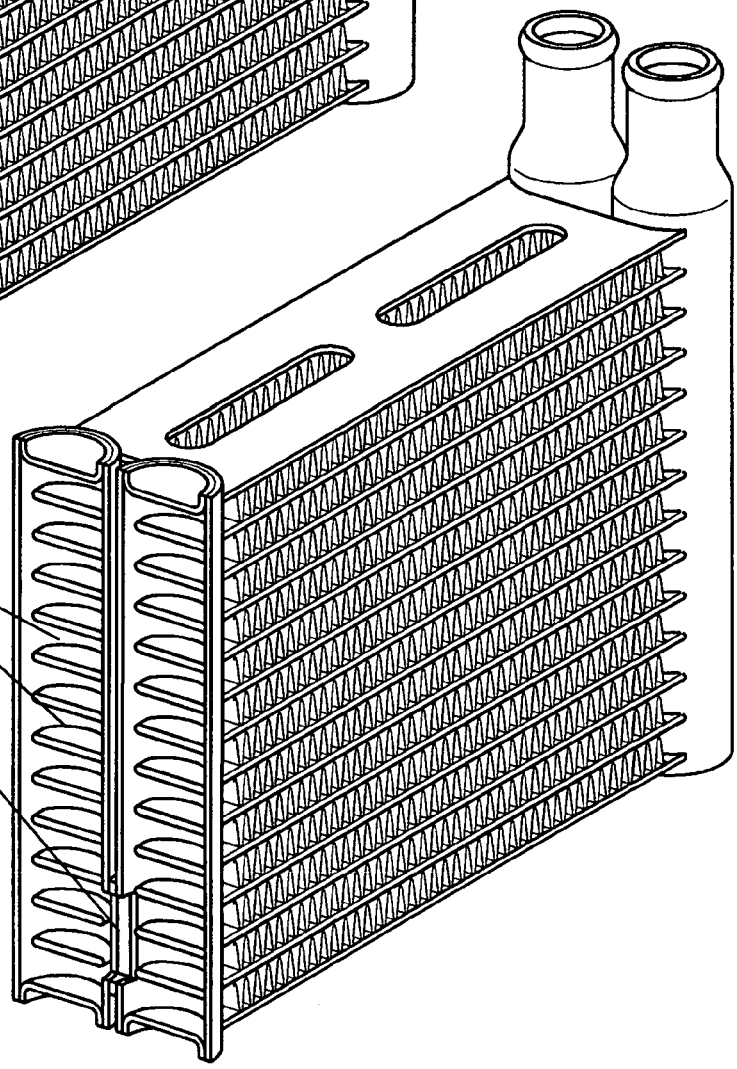
FIG. 5 shows a section through the heat exchanger of FIG. 4.
Figure 6:
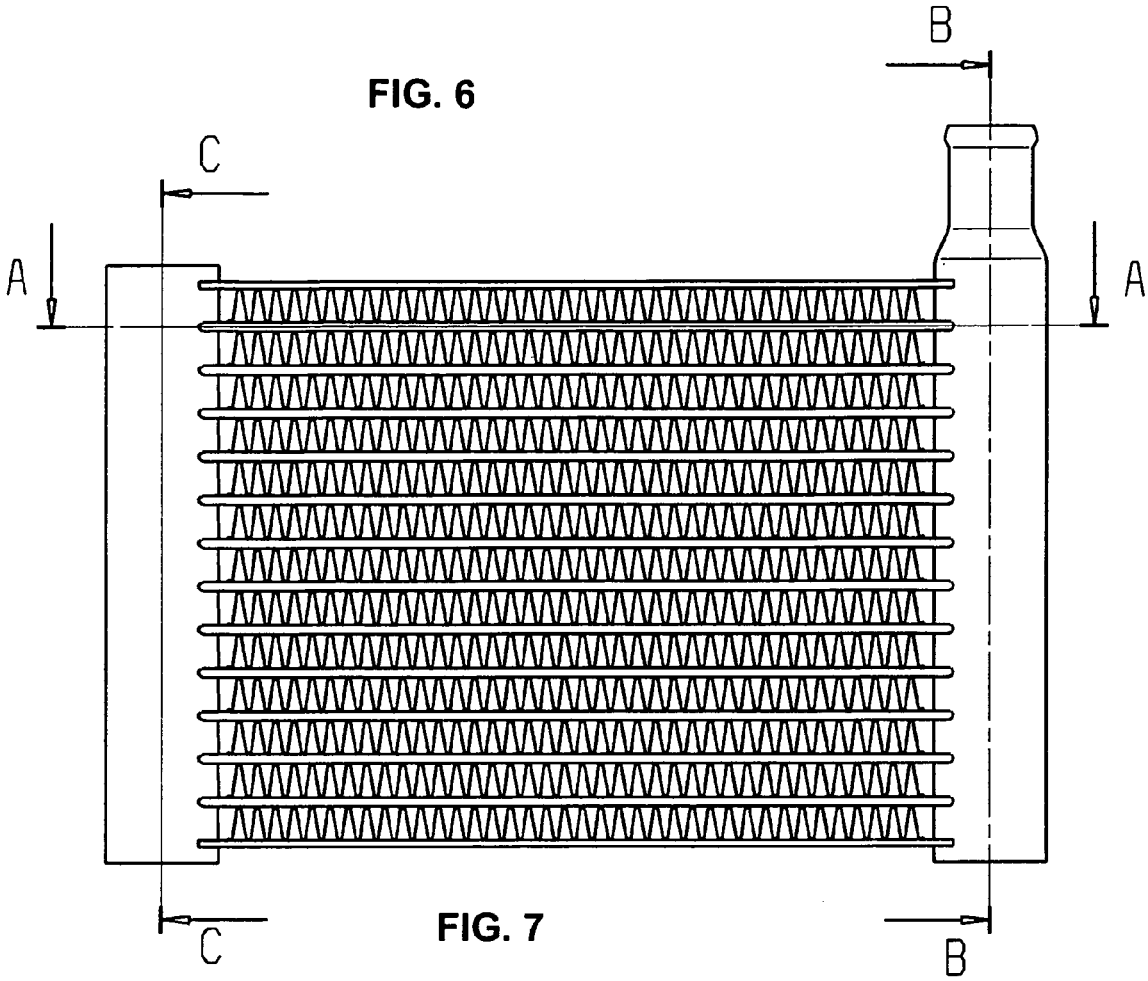
FIG. 6 shows a front view of the heat exchanger of FIGS. 4 and 5.
Figure 7:
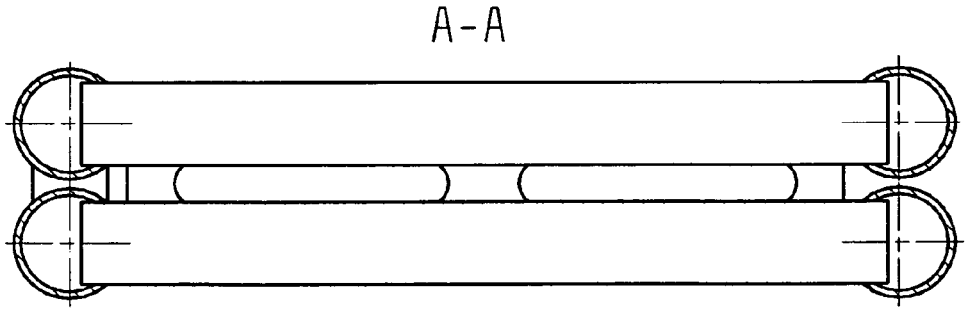
FIGS. 7-12 show sections of the heat exchanger of FIGS. 4-6 according to the nomenclature in FIG. 6.

As is well known, in order to increase the volume efficiency of the cylinder, and thereby the effectiveness of turbo charging, charge air can be cooled by means of an intercooler. An example of an intercooler is illustrated in FIGS. 1-3, and has at least four collection tubes 3.1-3.4 which define collection chambers or boxes 3. The illustrated intercooler has four single collection tubes 3.1-3.4 by way of example only, although double tubes (extruded or otherwise) can instead be provided in other embodiments. Coolant in the illustrated embodiment follows at least one outgoing route, which is between the first and second collection tubes, 3.1, 3.2 and at least one return route running in an opposite direction and lying between the third and fourth collection tubes 3.3, 3.4, whereby the outgoing route is defined by at least one flat tube and corrugated rib series, and the return route is defined by at least one other flat tube and corrugated rib series. In the illustrated embodiment, the two series of tubes and ribs are arranged one after the other (seen in the flow direction of charge air through the intercooler). Also in the illustrated embodiment, the flow direction of charge air is generally perpendicular to the corrugated ribs 2 to permit air flow therethrough. The flow direction of coolant is shown by the block arrows in FIG. 1 adjacent the connection pieces 4. This type of flow is often denoted as cross current flow.

In some embodiments, all individual components of the intercooler are aluminum, and are connected in a soldering furnace. FIG. 2 shows a section through the collecting tubes 3.2 and 3.3 of the intercooler, which are located a distance from the connection pieces 4. There also, arrows showing the route of coolant are provided.

The illustrated exemplary embodiment of FIGS. 1-3 also has a multiple part connection plate 5 consisting of two components: an upper component 5.1 defining a frame component, and another component 5.2 below the upper component 5.1 defining a generally flat component. A dome-like deformation denoted as an excess flow dome 7 can be constructed in the frame component 5.1. This excess flow dome 7 has a flow connection 70 with both the collection tubes 3.2 and 3.3 by means of openings 53 in the generally flat component 5.2. After coolant has flowed through flat tubes 1 between the first and second collecting tubes 3.1 and 3.2, it is redirected via the excess flow dome 7 from the outgoing route to the return route, and thereby flows through the other flat tubes 1 between the third and the fourth collecting tubes 3.3 and 3.4. The flat component 5.1 can contain a deep drawn trough resting on the outer corrugated rib 2 of the set of ribs 2. As FIG. 2 of the illustrated embodiment clearly shows, the flat component 5.2 contains two additional openings 53 in which the ends of the other collecting tubes 3.1 and 3.4 are contained and tightly soldered. The connection pieces 4 are, according to the embodiment example in FIGS. 1-3, again arranged in other openings in the frame component 5.1 and ensure the supply and discharge of fluid coolant belonging to the coolant circulation of the internal combustion engine and/or to a branch of the coolant circulation (not shown).

The connection plate 5 can serve as a device to attach the intercooler to the edge or other portion of the opening 60 of the casing 6. To this end, the connection plate 5 can be provided with attachment openings 57. A plate 50 closing the front side openings of the collecting tubes 3.1-3.4 can be located at the ends of the collecting tubes 3.1-3.4 opposite the connection plate 5, and can be constructed with corresponding bulges 52. In addition, a projecting edge 51 can be provided that supports the attachment of the intercooler when, for example, the projecting edge 51 is received within a groove (not shown) constructed in the casing 6.

Figure 8:
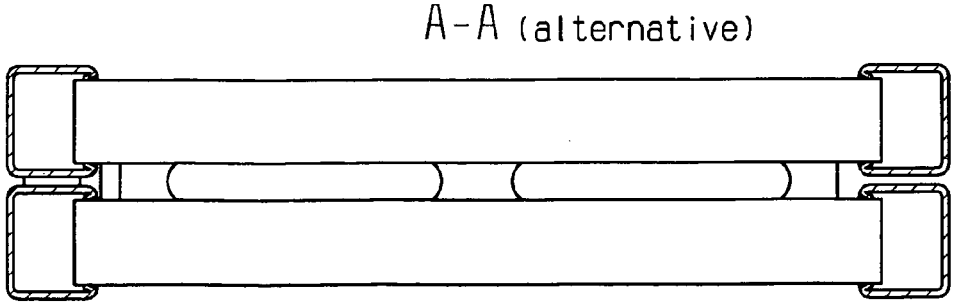
Figure 9:
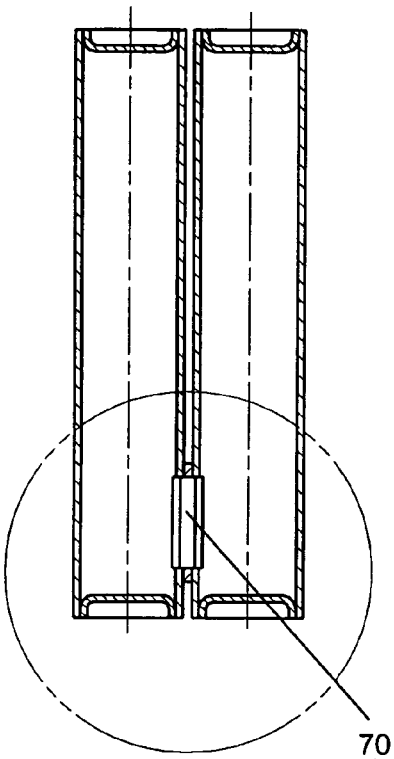
Figure 10:
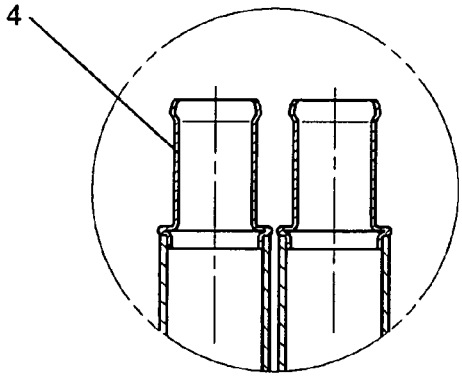
Figure 11:
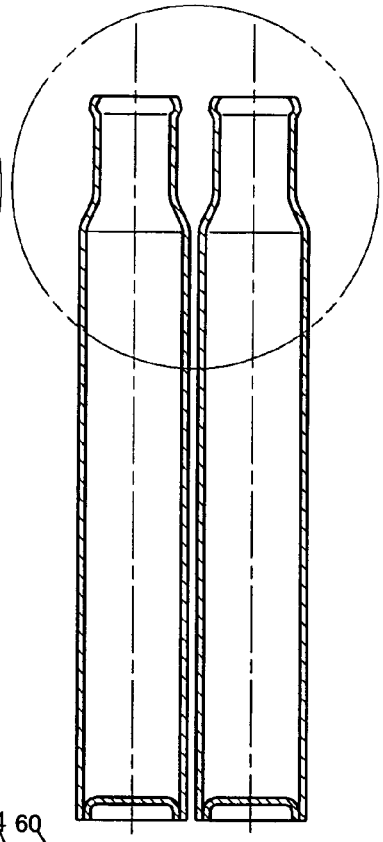
Figure 12:
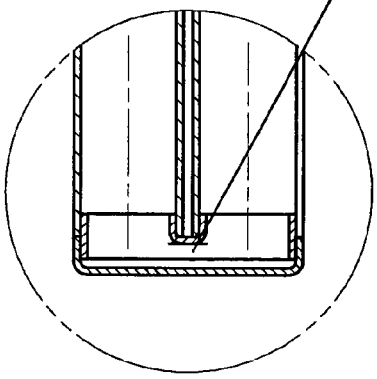

The previously-mentioned connection pieces 4 can be constructed integrally with the collecting tubes 3, such as when the collecting tubes 3 have an approximately round cross sectional shape as shown in FIGS. 4, 5, 6, and 11. In addition, the collecting tubes 3 can have other cross section shapes. FIG. 8 shows, as an example, approximately rectangular cross sectional tube shapes, although oval or other cross-sectional shapes are possible. In the case of different cross sectional tube shapes, a transition from a non-round cross sectional shape of a collecting tube 3 to a round cross sectional shape of the connection piece 4 can be provided by constructing the connection plate 5 in multiple components. For clarification, reference is again made to FIG. 3. The non-round openings 53, which correspond to the cross sectional shape of the collecting tubes 3, are present in the lower plate 5.2, while the round openings in which the connection pieces 4 are positioned, are in the upper plate 5.1.

Moreover, there are additional construction variants with respect to the design of the transfer of coolant from one of the collecting tubes to another, as is shown in the FIGS. 4, 5, 9, or 12 (see flow connection 70, for example). In some embodiments, such as that shown in FIG. 12, the flow connection 70 is integrated in the front side seals of the second and third collecting tubes 3.2 and 3.3. The tube walls can be interrupted in the other figures in order to create the flow connection 70.

All in all, a relatively manufacturing-friendly heat exchanger can be generated by utilizing one or more features of the present invention. The collecting tubes 3.1-3.4 can be manufactured as semi-finished parts, can be cut to length, and can be provided with slits 13. Welded or drawn flat tubes 1 can be cut to length and stacked with corrugated ribs 2. Also, the ends of the flat tubes 1 can be slid into the slits 13 of the collecting tubes 3.1-3.4. The connection plate 5 and the plate 50 (which can be an end plate) can be applied. In some embodiments, the whole construction is soldered in a soldering furnace, and is then available for the assembly in the casing 6 as an intercooler.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A heat exchanger, comprising:

first and second pluralities of flat tubes;

a plurality of corrugated ribs coupled to the first and second pluralities of flat tubes;

first, second, third, and fourth collection tubes coupled to and in fluid communication with the first and second pluralities of flat tubes;

at least one connection piece in fluid communication with the first and second pluralities of flat tubes;

a connection plate located on a front side of each of the coolant tubes and adapted to couple the heat exchanger within a casing through which charge air flows;

a first coolant route extending through the first plurality of flat tubes between the first and second collection tubes; and a second coolant route extending through the second plurality of flat tubes between the third and fourth collection tubes;

wherein the first plurality of flat tubes is positioned upstream of the second plurality of flat tubes in the direction of charge air through the heat exchanger;

, the heat exchanger further comprising an additional plate located on ends of the collection tubes opposite the connection plate, wherein the additional plate contains at least four protrusions to close the ends of the collection tubes.

2. The heat exchanger according to claim 1, wherein the collection tubes have at least one of a round, rectangular, and oval cross-sectional shape, and have a series of slits for the reception of the ends of the first and second pluralities of flat tubes.

3. The heat exchanger according to claim 1, wherein the collection tubes extend substantially parallel to each other.

4. A heat exchanger, comprising:

first and second pluralities of flat tubes;

a plurality of corrugated ribs coupled to the first and second pluralities of flat tubes;

first, second, third, and fourth collection tubes coupled to and in fluid communication with the first and second pluralities of flat tubes;

at least one connection piece in fluid communication with the first and second pluralities of flat tubes;

a connection plate located on a front side of each of the coolant tubes and adapted to couple the heat exchanger within a casing through which charge air flows;

a first coolant route extending through the first plurality of flat tubes between the first and second collection tubes; and a second coolant route extending through the second plurality of flat tubes between the third and fourth collection tubes; wherein the first plurality of flat tubes is positioned upstream of the second plurality of flat tubes in the direction of charge air through the heat exchanger, the connection plate comprises a frame coupled to a substantially flat component, and the substantially flat component has at least four openings that receive ends of the collection tubes.

5. A heat exchanger, comprising:

first and second pluralities of flat tubes;

a plurality of corrugated ribs coupled to the first and second pluralities of flat tubes;

first, second, third, and fourth collection tubes coupled to and in fluid communication with the first and second pluralities of flat tubes;

at least one connection piece in fluid communication with the first and second pluralities of flat tubes;

a connection plate located on a front side of each of the coolant tubes and adapted to couple the heat exchanger within a casing through which charge air flows;

a first coolant route extending through the first plurality of flat tubes between the first and second collection tubes; and a second coolant route extending through the second plurality of flat tubes between the third and fourth collection tubes; wherein the first plurality of flat tubes is positioned upstream of the second plurality of flat tubes in the direction of charge air through the heat exchanger, the connection plate comprises a frame coupled to a substantially flat component, and the substantially flat component is shaped to define a trough, and wherein the trough is located on an outermost rib of the plurality of corrugated ribs.

6. The heat exchanger according to claim 5, wherein the frame rests flat upon a continuous edge of the trough.

7. The heat exchanger according to claim 5, wherein the additional plate contains a fastener adapted to engage a casing in which the heat exchanger is installed.

* * * * *